United States Patent [19]

Geringer et al.

[11] Patent Number: 5,000,497

[45] Date of Patent: Mar. 19, 1991

[54] ELECTROMAGNETIC DOOR LOCK DEVICE

[76] Inventors: Arthur Geringer, 5029 E. Jacobs Ct., Agoura, Calif. 91301; Richard Geringer, 2663 Riata Ct., Camarillo, Calif. 93010; David Geringer, 28364 Balkin, Agoura, Calif. 91301

[21] Appl. No.: 498,786

[22] Filed: Mar. 26, 1990

[51] Int. Cl.[5] ..... E05C 17/56

[52] U.S. Cl. ..... 292/251.5; 292/DIG. 55; 292/144; 292/157

[58] Field of Search ..... 292/251.5, 300, 302, 292/346, DIG. 55, DIG. 40, 144, 157

[56] References Cited

U.S. PATENT DOCUMENTS

| | | | |
|---|---|---|---|
| 3,831,988 | 8/1974 | Stelma | 292/302 |
| 4,487,439 | 12/1984 | McFadden | 292/251.5 |
| 4,826,223 | 5/1989 | Geringer et al. | 292/251.5 |
| 4,861,080 | 8/1989 | Frolov | 292/251.5 |

*Primary Examiner*—Richard E. Moore
*Attorney, Agent, or Firm*—John J. Posta, Jr.

[57] ABSTRACT

The improvement as in an electromagnetic door lock device. The device includes an electromagnet which is secured to the underside of the top of door frame, and an armature connected to the top of a door hinged in the frame. The armature moves between a resting unlocked down position and a locking position in which the armature extends up toward the electromagnet being attracted thereto. When in that attracted position, the armature is intercepted by one or more tab plates depending from one or both of the opposite sides of the electromagnet so that the door cannot be opened. Deenergizing the electromagnet causes the armature to fall down to the unlocked position. The improvement includes a protrusion from one or both of the opposite sides of the armature, which protrusion fits within a notch on the underside of the tab plate to lock these two parts together. The tab plate may have adjustment slots for aligning the notch and protrusion. Moreover, the back of the tab plate and adjoining side thereof may be toothed and grooved to prevent inadvertent movement of the tab plate. In one embodiment, a separate locking plate secured to the electromagnet side above the tab plate has toothed surfaces which may be stepped facing toothed mating surfaces of the tab plate to hold the tab plate against movement. The teeth may be pointed or square in configuration.

22 Claims, 2 Drawing Sheets

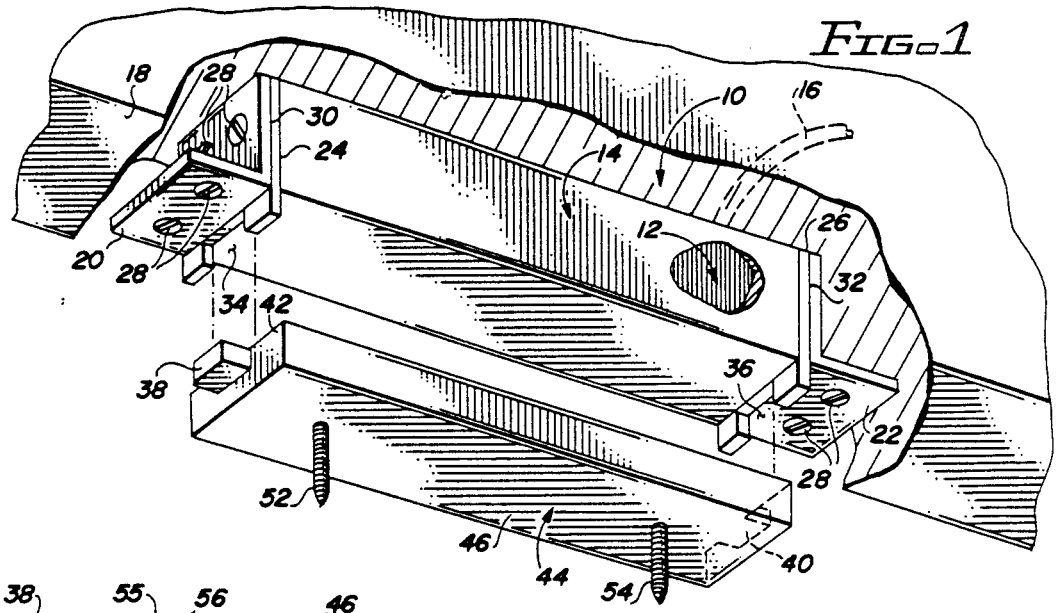
FIG. 1
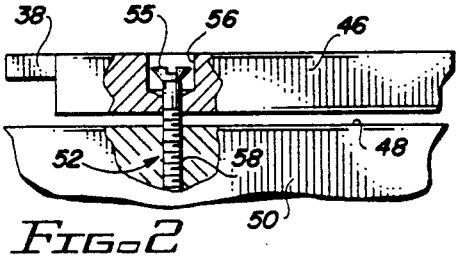
FIG. 2
FIG. 3
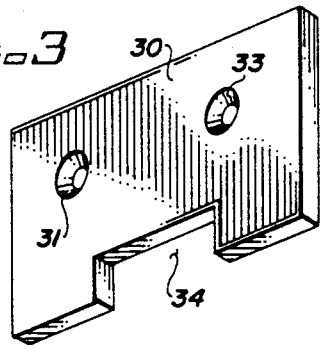
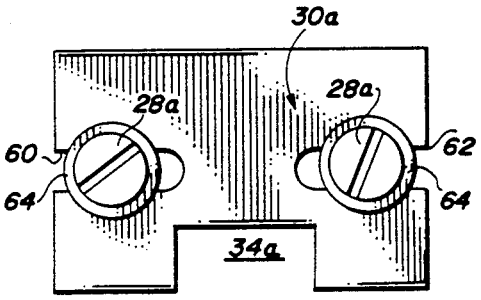
FIG. 4
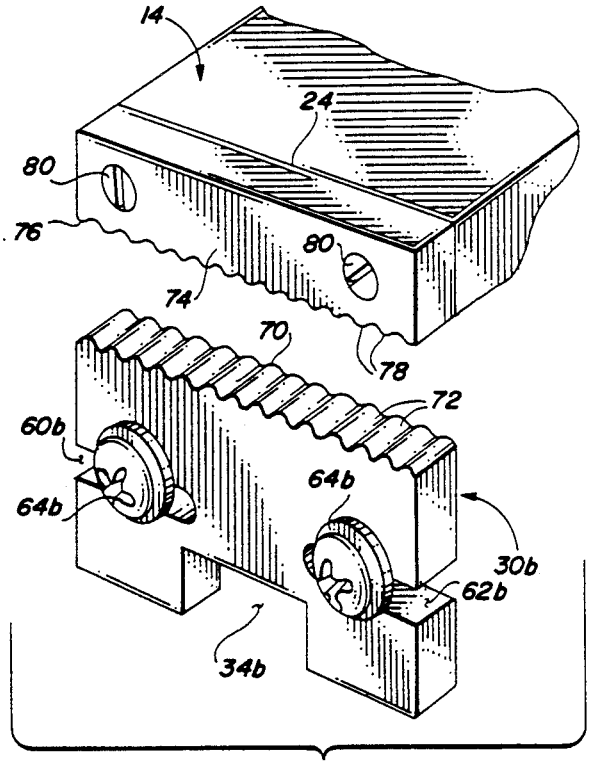
FIG. 5

ELECTROMAGNETIC DOOR LOCK DEVICE

BACKGROUND OF THE INVENTION

1. Field of the Invention

The present invention generally relates to locking devices and more particularly to an improvement in an electromagnetic door lock device.

2. Prior Art

Various types of electromagnetic door lock devices have been devised and utilized. Most are cumbersome, expensive, difficult to install and adjust and subject to damage. See, for example, U.S. Pat. No. 4,487,437, which discloses a device which operates under shear and employs a specially-configured electromagnet housing which can easily be damaged, as can the electromagnet inside the housing, if the door lock components are not precisely aligned. Any misalignment also causes the lock to malfunction, bind, jam, etc. Such a lock has limited applications.

The door lock of U.S. Pat. No. 4,826,223 solves such problems by placing a separate tab plate on one or both opposite ends of the housing so that only the tab plate is subject to stress by the movable armature of the lock. However, it would be desirable to further improve the ease with which a device such as that of U.S. Pat. No. 4,826,223 can be installed, aligned and adjusted for ideal functioning. In some cases, as when the armature and electromagnet are not in proper alignment, the tab of the tab plate of the aforesaid patent has had a tendency to bind against the armature when the electromagnet is energized, delaying opening of the door when the electromagnet is deenergized. It would be desirable to eliminate this delay, while facilitating easy visual alignment of the door lock components. Such an improvement to provide these advantages should be adjustable, simple, efficient and durable.

SUMMARY OF THE INVENTION

The improvement of the present invention satisfies all the foregoing needs. The improvement is substantially as set forth in the Abstract of the Disclosure.

Thus, the improvement is an armature plate having an extension or protrusion at one or both of the two opposite ends thereof, which mates with an expanded notch in the underside of the tab plate on one or both of the opposite sides of the electromagnetic housing of an electromagnet door lock device. In one embodiment, a spaced pair of elongated slots receive locking screws, so that the tab plate can be adjusted easily in position on the housing to align with the armature protrusion. In another embodiment, the rear of the tab plate and adjoining surface of the housing side are toothed to prevent slippage of the tab plate once it is in the proper alignment.

In another embodiment, a locking plate may be secured to the housing side above the tab plate and bear toothed surfaces intermeshing with toothed surfaces on the tab plate to prevent tab plate movement. The adjoining tab plate and locking plate surfaces may be stepped in order to increase the overall gripping area. The tooth surfaces can be saw-toothed with pointed teeth or can have square teeth or the like.

Various other features of the present invention are set forth in the following detailed description and accompanying drawings.

DRAWINGS

FIG. 1 is a schematic front perspective view of a first preferred embodiment of the improvement of the present invention in an electromagnetic door lock device, shown installed in a doorway, with the armature thereof therebelow;

FIG. 2 is an enlarged, fragmentary schematic front elevation, partly broken away, showing the interconnection between the armature of FIG. 1 and a door top.

FIG. 3 is an enlarged schematic front perspective view of a tab plate of FIG. 1;

FIG. 4 is an enlarged schematic front elevation of a second preferred embodiment of the tab plate of the present invention;

FIG. 5 is an enlarged schematic front perspective view of a third preferred embodiment of the tab plate of the present invention, shown with a novel locking plate adjacent thereto;

DETAILED DESCRIPTION

FIGS. 1–3

Figure 6:
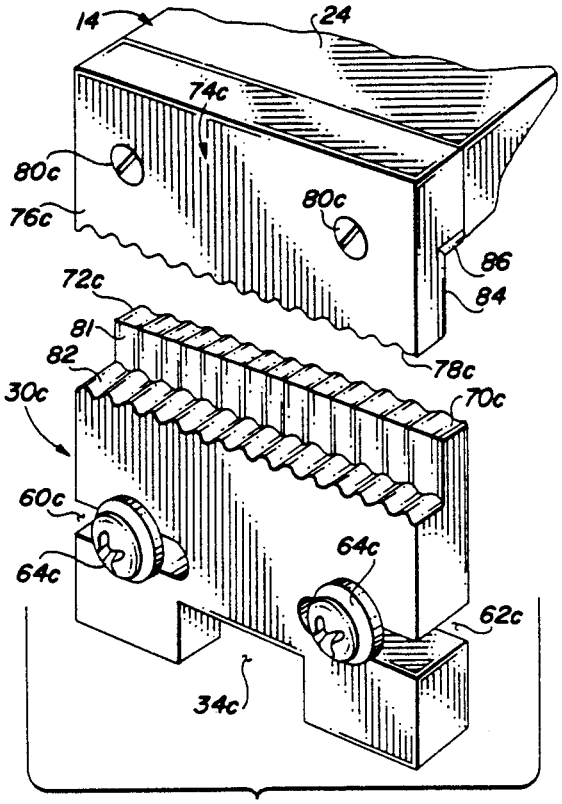
FIG. 6 is an enlarged schematic front perspective view of a fourth preferred embodiment of the tab plate of the present invention, shown with a novel locking plate adjacent thereto.

Now referring more particularly to FIGS. 1–3 of the drawings, a first preferred embodiment of the improvement of the present invention is schematically depicted therein. Thus, device 10 is shown which comprises an electromagnet 12 disposed in a rectangular metallic housing 14 or the like and connected to a remote electrical power source such as house current (not shown) by an electrical conduit 16 passing through housing 14 to electromagnet 12.

Housing 14 is releasably held in place on the underside of the top of a door frame 18 (and forms part thereof) by a pair of L-shaped brackets 20 & 22 secured to opposite sides 24 & 26 of housing 14 and to frame 18 by screws 28.

One part of the improvement of the present invention comprises a pair of flat vertical tab plates 30 & 32 secured by screws 28 through openings 31 & 33 to sides 24 & 26 and disposed between brackets 20 & 22 and sides 24 & 26, respectively, as shown in FIG. 1. Plates 30 & 32 are preferably of steel or other durable metal and depend below the bottom of housing 14.

Plates 30 & 32 define generally centrally located rectangular open bottomed notches 34 & 36 extending up from the bottom ends thereof and adapted to receive and retain generally centrally located rectangular protrusions 38 & 40 extending outwardly from the opposite sides 42 & 44 of a rectangular armature plate 46 disposed below housing 14 and connected to the top surface 48 of a door 50 (FIG. 2) hinged in frame 18. Armature plate 46 is formed of metal attracted to electromagnet 12 when the latter is energized and is connected to surface 48 by a spaced pair of depending screws 52 & 54, the head 55 of each of which is vertically seated in a loose pocket 56 in armature plate 46 and the shank 58 of which extends down through pocket 56 and is threaded into surface 48.

With this arrangement, armature plate 46 can move between the resting position shown in FIGS. 1 & 2 where protrusions 38 & 40 are below notches 34 & 36, and an upwardly extending locking position, due to energization of electromagnet 12 and attraction of plate 46 thereof, where protrusions 38 & 40 are locked into notches 34 & 36 so that door 50 cannot be opened. When electromagnet 12 is deenergized, plate 46 falls back to the resting position on surface 48 of door 50 and door 50 can be opened. It will be understood that the described locking procedure only takes place when door 50 is closed so that it has armature plate 46 fully aligned below housing 14. It will also be understood that notches 34 & 36 can be made wide enough relative to the width of protrusions 38 & 40 so that the latter will not bind on the edges defining notches 34 & 36 and therefore armature plate 46 will release instantly to the unlocked position when desired. Sufficiently wide notches 34 & 36 also preclude the necessity of fine precise alignment of armature plate 46 and housing 14 in order for device 10 to function properly. Accordingly, the present inprovement in device 10 provides superior results.

FIG. 4

A first modified version of the tab plate of the invention is shown in FIG. 4 and one or a pair thereof can be fully substituted for tab plates 30 & 32 in device 10. Thus, tab plate **30*a* is shown which includes notch 34*a* and bears the same numerals as tab plate 30 for similar features, but which numerals are succeeded by the letter "a". Plate 30*a* differs from tab plate 30 only in that the screw holes thereof are expanded into two transverse slots 60 & 62 extending in from the opposite ends thereof and through which screws 28*a* are received, the enlarged heads 64 thereof overlapping the sides of each slot 60 & 62, so that plate 30*a* can be slid back and forth on the side 24 (not shown) of the electromagnet housing 14 (not shown) in order to properly align plate 30*a* with protrusion 38 on plate 46. Plate 30*a*** provides improved adjustability.

FIG. 5

A second modified version of the tab plate used in device 10 is shown in FIG. 5. Thus, tab plate **30*b* is shown, which is identical to tab plate 30*a*. Components thereof bear the same numerals as tab plate 30*a* but are succeeded by the letter "b". Plate 30*b* differs from plate 30*a*** as follows:

a) the top surface 70 of plate **30*b* bears teeth 72; and, b) a locking plate 74 is securable to housing 14 directly above plate 30*b* and bears on the lower end 76 thereof teeth 78 which mesh with teeth 72 to prevent any forward and rearward shifting whatsoever of plate 30*b*; plate 74 is locked to side 24 of housing 14 by screws 80**.

FIG. 6

A third modified version of the tab plate used in device 10 is shown in FIG. 6. Thus, tab plate **30*c* is shown. Components thereof similar to those of tab plate 30*b* and locking plate 74 bear the same numerals but are succeeded by the letter "c". Plates 30*c* and 74*c* differ from plates 30*b* and 74** only as follows:

a) plate **30*c* has a stepped configuration, providing additional toothed gripping surfaces 80 & 82; and, b) plate 74*c* has a matching stepped configuration providing additional toothed gripping surfaces 84 & 86**.

This arrangement assures further gripping power between plates **30*c* and 74*c*** to prevent relative rearward-forward movement therebetween.

FIGS. 7 & 8

Figure 7:
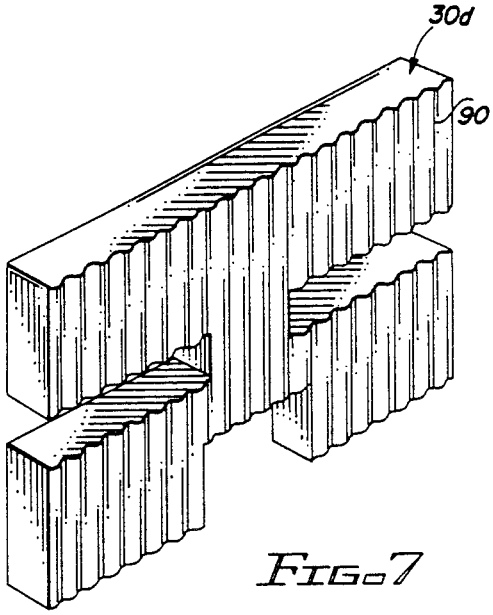
FIG. 7 is an enlarged schematic rear perspective view of a fifth preferred embodiment of the tab plate of the present invention.
Figure 8:
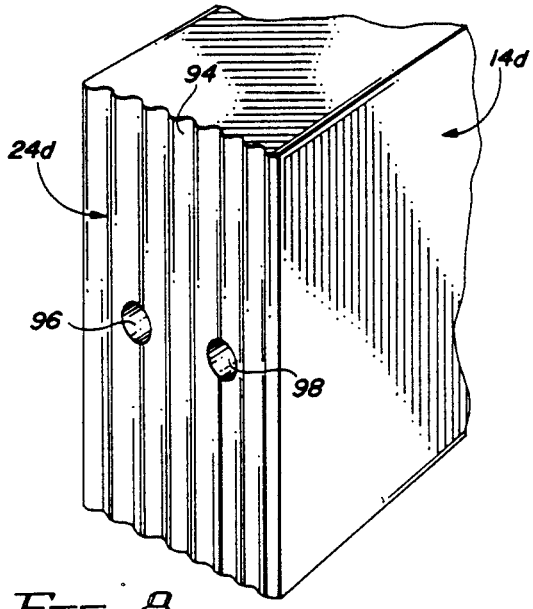
FIG. 8 is an enlarged schematic, fragmentary perspective view of the grooved side of an electromagnetic housing adapted to abut the tab plate of FIG. 7; and, FIG. 9 is an enlarged schematic fragmentary side perspective view of the upper portion of a sixth preferred embodiment of the tab plate of the present invention.

A fourth modified version of the tab plate used in device 10 is schematically depicted in FIG. 7 and a modified mating surface on the side of housing 14 is shown in FIG. 8. Components thereof similar to those of tab plate **30*a* and surface 24 bear the same numerals but are succeeded by the letter "d". Tab plate 30*d* differs from tab plate 30*a* only in the back surface 90 thereof which is provided with vertical rows of pointed teeth 92 adapted to mate with vertical rows of pointed teeth 94 on the adjoining surface 24*d* of housing 14*d* bearing screw holes 96 & 98 to prevent relative movement between tab plate 30*d* and housing 14*d* in any direction other than vertically. Accordingly, tab plate 30*d* can be locked to housing 14** without the use of a locking plate.

FIG. 9

Figure 9:
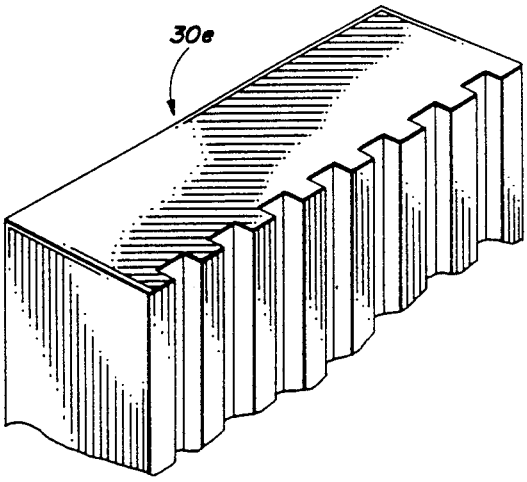

A fifth modified version of the tab plate used in device 10 is schematically depicted in FIG. 9. Thus, tab plate **30*e* is shown which differs from tab 30*d* only in that teeth 90*e* are square faced and not pointed and squared by square grooves and are adapted to mate with similar square faced teeth and grooves (not shown) in the adjoining surface of the electromagnet housing (not shown); otherwise, identical to housing 14*d*. Tab plate 30*e* has the advantages of tab plate 30*d***.

Although the electromagnet 12 has been shown in the embodiment disclosed in FIG. 1 as being contained within a housing 14, it should be readily understood that the housing 14 could readily be dispensed with and the tab plates 26 & 28 could then be secured directly to electromagnetic 12, without departing from the scope and intent of the invention.

It should be understood that the electromagnet and tab plates can readily be secured to the side of a door jamb and the armature could be mounted on the side of a door, utilizing the inventive concepts disclosed herein, without departing from the scope or spirit of this invention.

Various other modifications, changes, alterations and additions can be made in the improvements of the present invention, their components and parameters. All such changes, modifications, alterations and additions as are within the scope of the appended claims form part of the present invention.

What is claimed is:

1. In an electromagnetic door lock device which includes an electromagnet in a housing connected to a remote power source and to the underside of the top of a door frame, an armature which is magnetically attracted to the electromagnet when the latter is energized and which is releasably connected to the top of a door hinged in said frame for movement between a down unlocked position when the electromagnet is deenergized and an upper locked position when said electromagnet is energized, and lock means in the form of one or more tab plates connected to one or both of the two opposite ends of said housing and depending therefrom to intercept said armature only when the latter is in said up locked position, the improvement which comprises providing said armature with at least one protrusion extending outwardly from at least one of the two opposite sides thereof and wherein said tab plate has an upwardly extending bottom notch for receiving said protrusion to lock said armature to said tab plate only when said armature is in said up position.

2. The improvement of claim 1 wherein said tab plate also includes a spaced, parallel, generally horizontal pair of elongated slots through which locking bolts extend for adjustably securing said tab plate against a side of said housing to seat said protrusion properly in said notch.

3. The improvement of claim 1 wherein there are two of said tab plates, one on each of said two opposite sides of said housing, each said tab plate having one said notch, and wherein there are two of said protrusions, one on each of the two opposite sides thereof matching said notches.

4. The improvement of claim 1 wherein said device includes a locking plate for each said tab plate, said locking plate being releasably connected to a side of said housing above said tab plate, said locking plate and said tab plate having opposing toothed surfaces adapted to interlock to rigidly secure said tab plate against movement.

5. The improvement of claim 4 wherein said opposing toothed surfaces are stepped to increase the total surface area thereof.

6. The improvement of claim 4 wherein said teeth have pointed edges.

7. The improvement of claim 4 wherein said teeth have a square configuration.

8. The improvement of claim 1 wherein the back of said tab plate and the adjoining side of said housing have mating which prevent movement.

9. The improvement of claim 8 wherein said teeth are pointed.

10. The improvement of claim 8 wherein said teeth have a square configuration.

11. The improvement of claim 8 wherein said teeth are vertical in order to prevent lateral movement of said tab plate.

12. An electromagnetic locking assembly comprising:

a) an electromagnet, b) energizing means for activating said electromagnet, c) an armature located in close proximity to said electormagnet, and d) alignment means to guide and position said armature when it is attracted to said electromagnet when it is activated by said energizing means, said alignment means including:

1) at least one protrusion on said armature extending outwardly from at least one of two opposite ends thereof, and 2) lock means in the form of one or more tab plates which have an upwardly extending notch for receiving and releasably retaining said protrusion to prevent lateral movement of said armature with respect to said electromagnet when said electromagnet is energized.

13. The locking assembly of claim 12 wherein said tab plate also includes a spaced, parallel, generally horizontal pair of elongated slots through which locking screws extend for adjustably securing said tab plate against a side of said housing to seat said protrusion properly in said notch.

14. The locking assembly of claim 12 wherein there are two of said tab plates, one on each of said two opposite sides of said housing, each said tab plate having one said notch, and wherein there are two of said protrusions, one on each of the two opposite sides thereof matching said notches.

15. The locking assembly of claim 12 wherein said device includes a locking plate for each said tab plate, said locking plate being connected to a side of said electromagnet above said tab plate, said locking plate and said tab plate having opposing toothed surfaces adapted to interlock to rigidly secure said tab plate against movement.

16. The locking assembly of claim 15 wherein said opposing toothed surfaces are stepped to increase the total surface area thereof.

17. The locking assembly of claim 15 wherein said teeth have pointed edges.

18. The locking assembly of claim 15 wherein said teeth have a square configuration.

19. The locking assembly of claim 12 wherein the back of said tab plate and the adjoining side of said housing have mating teeth which prevent movement.

20. The locking assembly of claim 19 wherein said teeth are pointed.

21. The locking assembly of claim 19 wherein said teeth have a square configuration.

22. The locking assembly of claim 19 wherein said teeth are perpendicular to the direction of movement of the door in order to prevent lateral movement of said tab plate.

* * * * *